US008922445B2

(12) United States Patent
Ngo Bui Hung

(10) Patent No.: US 8,922,445 B2
(45) Date of Patent: Dec. 30, 2014

(54) LOW-PROFILE BROADBAND MULTIPLE ANTENNA

(75) Inventor: Frédéric Ngo Bui Hung, Colombes (FR)

(73) Assignee: Thales, Neuilly-sur-Seine (FR)

( * ) Notice: Subject to any disclaimer, the term of this patent is extended or adjusted under 35 U.S.C. 154(b) by 697 days.

(21) Appl. No.: 13/265,818

(22) PCT Filed: Feb. 23, 2010

(86) PCT No.: PCT/EP2010/052303

§ 371 (c)(1),
(2), (4) Date: Mar. 7, 2012

(87) PCT Pub. No.: WO2010/121851

PCT Pub. Date: Oct. 28, 2010

(65) Prior Publication Data

US 2012/0182196 A1 Jul. 19, 2012

(30) Foreign Application Priority Data

Apr. 24, 2009 (FR) ..... 09 02008

(51) Int. Cl.
*H01Q 9/04* (2006.01)
*H01Q 9/16* (2006.01)

(Continued)

(52) U.S. Cl.
CPC . *H01Q 1/52* (2013.01); *H01Q 5/00* (2013.01); *H01Q 5/0034* (2013.01); *H01Q 5/0072* (2013.01); *H01Q 9/28* (2013.01); *H01Q 21/10* (2013.01)
USPC ..... 343/792; 343/790; 343/905

(58) Field of Classification Search
CPC ..... H01Q 5/00; H01Q 5/001; H01Q 5/0003; H01Q 5/0017; H01Q 5/0027; H01Q 5/0031; H01Q 5/0034; H01Q 5/0037; H01Q 5/0041; H01Q 5/0086; H01Q 5/0093; H01Q 5/0051; H01Q 5/0058; H01Q 5/0072; H01Q 9/16; H01Q 9/18; H01Q 9/20; H01Q 9/28; H01Q 9/30; H01Q 9/32; H01Q 9/145; H01Q 21/10; H01Q 21/30
USPC ..... 343/715, 745, 790, 791, 792, 794, 810, 343/812, 813, 814, 816, 820, 822, 829, 853, 343/905
See application file for complete search history.

(56) References Cited

U.S. PATENT DOCUMENTS 2,966,640 A 12/1960 Eiland, Jr.
3,879,735 A * 4/1975 Campbell et al. ..... 343/792

(Continued)

FOREIGN PATENT DOCUMENTS

DE 34 06 580 A1 8/1985
FR 2 299 735 A1 8/1976

(Continued)

OTHER PUBLICATIONS

"5.7.2 Transformer Matching; 5.7.3 Auto-Transformers", "High Frequency and Microwave Engineering", 2001, pp. 233-235, Elsevier B.V., Butterworth-Heinemann, Oxford, England, XP002582063.

*Primary Examiner* — Hoang V Nguyen
*Assistant Examiner* — Patrick Holecek
(74) *Attorney, Agent, or Firm* — Baker & Hostetler LLP

(57) ABSTRACT

A low-profile broadband multiple antenna, comprises: a dipole arranged in the top part of said antenna, said dipole comprising at least one first top antenna element connected to the core of a multi-axial cable comprising a core and n sheaths and the bottom individual element of which is connected to the first sheath adjacent to the core, a connection device positioned between a top element of a dipole and the bottom element of said dipole the top element is connected to the sheath of index (k−1) of the multi-axial cable after the assembly comprising the core and the sheaths of index (1 to k−1) has been wound in Q turns around a magnetic core and the bottom element of the dipole is connected to the sheath of index k, and said connection device comprises at least one single-wire winding of P turns on the same magnetic core linking said bottom element of said dipole to the sheath of index (k−1), at the point corresponding to the start of the winding in order to provide the broadband impedance matching and the power supply for the dipole.

7 Claims, 5 Drawing Sheets

(51) Int. Cl.

| | |
|---|---|
| ***H01Q 1/00*** | (2006.01) |
| ***H01Q 1/52*** | (2006.01) |
| ***H01Q 5/00*** | (2006.01) |
| ***H01Q 9/28*** | (2006.01) |
| ***H01Q 21/10*** | (2006.01) |

(56) References Cited

U.S. PATENT DOCUMENTS

| | | | | |
|---|---|---|---|---|
| 3,961,331 | A * | 6/1976 | Campbell | 343/792 |
| 4,031,487 | A | 6/1977 | Rannou | |
| 4,369,449 | A * | 1/1983 | MacDougall | 343/790 |
| 7,053,850 | B1 * | 5/2006 | Bogdans et al. | 343/792 |
| 7,183,992 | B2 * | 2/2007 | Hung | 343/790 |
| 7,289,080 | B1 * | 10/2007 | Bohlman | 343/793 |

FOREIGN PATENT DOCUMENTS

| | | |
|---|---|---|
| FR | 2 300 429 A1 | 9/1976 |
| FR | 2 758 011 A1 | 7/1998 |

* cited by examiner

LOW-PROFILE BROADBAND MULTIPLE ANTENNA

CROSS-REFERENCE TO RELATED APPLICATIONS

This application is a National Stage of International patent application PCT/EP2010/052303, filed on Feb. 23, 2010, which claims priority to foreign French patent application No. FR 0902008, filed on Apr. 24, 2009, the disclosures of which are incorporated by reference in their entirety.

FIELD OF THE INVENTION

The subject of the invention relates to the multiple antennas that are used notably for radio communication equipment.

BACKGROUND

The antennas according to the invention are applied, for example, to equip vehicles and for a frequency band varying from 225 to 400 MHz. They may operate with space diversity, all the antenna elements forming the antenna then operating in one and the same frequency range. The antennas may also consist of several antenna elements operating in mutually different frequency bands. The position of the different antenna elements forming the antenna, relative to one another, depends on the application.

An antenna according to the invention may take the form of a whip, also known as "low profile", have at least two independent inputs or power supplies, retain an omnidirectional coverage and be predisposed to signal processing of space diversity type.

Hereinafter in the description, the expression "low profile" corresponds to the transversal dimensions of the antenna itself, that is to say its section.

It is known practice to produce a double antenna including a power supply means. For example, FIGS. 1A and 1B (respectively seen in perspective and seen in cross section) represent an antenna system consisting of a first dipole 1 consisting of a top radiating element is and a bottom radiating element 1*b* in the form of a skirt, a second dipole 2, placed collinearly to the dipole 1 and consisting of a top radiating element 2*s* in the form of a counter-skirt (overturned skirt) and a bottom element 2*b* also in the form of a skirt, a first coaxial cable 3 passing through the assembly 2*b*, 2*s*, 1*b* and powering the dipole 1 via the electrical connections of its core 5 with the element 1*s* and of its sheath 6 with the element 1*b*, a second coaxial cable 4 powering the dipole 2 via the electrical connections of its core 7 to a quarter-wave trap 9, usually called "stub", at the level of the point A and of its sheath 8 with the element 2*b*. The drawbacks with this type of structure notably stem from the use of the stub. In practice, it is known that the effectiveness of the "stub" is governed by the relationship giving its apparent impedance $$Zstub = Zctg(2\pi L/\lambda)$$

with Zc=60 In (D/d), D being the diameter of the stub, d the apparent diameter of the cables that pass through it, L the length of the stub and X the wavelength.

Since the effectiveness of the stub increases in direct proportion to the apparent impedance Zstub, the result is that, as the bandwidth to be covered becomes wider, the value required for D becomes greater, which runs counter to the search for a low profile for an antenna while retaining a wide antenna bandwidth.

Another double antenna structure is described in the patent FR 2 300 429 and represented in FIG. 2. This antenna system consists of a first dipole 1 consisting of a top radiating element 1*s* linked to the core 11 of a multi-axial line 12 and a bottom radiating element 1*b* linked to the sheath $\mathbf{12}_1$ of the multi-axial line, a second dipole 2 consisting of a top radiating element 2*s* linked to the sheath $\mathbf{12}_1$ at the point 10 and a bottom radiating element 2*b* linked to the sheath $\mathbf{12}_2$ of the multi-axial line 12. Such a system, while effective, does, however, present the drawback of requiring the implementation, in order to cover a wide frequency band, thick radiating elements, for example, cone sections, disks, etc., which result in an increase in antenna size, which runs counter to one of the objectives sought, namely, to minimize the size of the antenna while retaining a desired bandwidth.

SUMMARY OF THE INVENTION

One of the objectives of the invention is to provide an antenna system which is capable of covering a wide frequency band based on thin, and therefore low-profile, radiating elements. To achieve these objectives, the structure of said antenna makes it possible to power collinearly disposed dipoles without using "stubs" whose transversal dimensions are significant when a wide frequency band has to be covered.

A double antenna, produced according to the invention and operating in the 225 to 400 MHz UHF band takes the form, for example, of a whip 2.5 m high and approximately 25 mm in diameter, whereas the similar devices on the market designed according to the prior art would have a diameter greater than 100 mm.

The object of the invention relates to a low-profile broadband multiple antenna comprising at least two dipoles, each dipole k designated $D_k$ consisting of a top antenna element $D_{ks}$ and a bottom antenna element $D_{kb}$, said antenna being powered by a coaxial cable comprising a core and n sheaths arranged concentrically around the core, with k varying from 1 to n, characterized in that it comprises at least the following elements arranged as indicated hereinbelow:

a dipole $D_1$ (k=1) arranged in the top part of said antenna, said dipole $D_1$ comprising at least one first top antenna element $D_{1s}$ connected to the core of said multi-axial cable comprising n sheaths and the bottom individual element $D_{1b}$ of which is connected to the first sheath adjacent to the core, a connection device positioned between a top element $D_{ks}$ of a dipole $D_k$ (k>1) and the bottom element $D_{kb}$ of said dipole $D_k$, the top element $D_{ks}$ is connected at a point to the sheath of index (k−1) of the multi-axial cable after the assembly comprising the core and the sheaths of index (1 to k−1) has been wound in Q turns around a magnetic core and the bottom element $D_{kb}$ of the dipole $D_k$ is connected to the sheath of index k at a point, and in that [said connection device comprises at least] at least one single-wire winding of P turns arranged on the same magnetic core links a bottom point of said bottom element $D_{kb}$ of said dipole $D_k$ to the sheath of index (k−1) at the point corresponding to the start of the winding in order to provide the broadband impedance matching and the power supply for the dipole $D_k$.

The magnetic element is, for example, a toroid or a tube.

All the dipoles $D_k$ forming said antenna can operate in the same frequency range.

The dipoles $D_k$ forming the antenna can also be powered with different powers.

The invention also relates to an antenna system comprising at least one antenna comprising two dipoles, each dipole k designated $D_k$ consisting of a top antenna element $D_{ks}$ and a bottom antenna element $D_{kb}$, said antenna being powered by a coaxial cable comprising a core and two sheaths arranged concentrically around the core, with k equal to 1 or 2, characterized in that it comprises two separate coaxial cables allowing said antenna to be connected to two separated radio channels, and in that the core of the first cable corresponds to the extension in the vehicle of the core of the invention and in that the sheath of this cable corresponds to the extension of a first sheath, whereas a second sheath extends into the space Int only by a length sufficient to be connected to the core of the second cable at a point F, said sheaths of the first and second cables are in contact with one another and are linked to a counter-skirt at a point M to form a quarter-wave balun system.

The dipoles are, for example, adapted to operate in the frequency range [225-400 MHz].

BRIEF DESCRIPTION OF THE DRAWINGS

Other features and advantages of the device according to the invention will become more apparent from reading the following description of an exemplary embodiment, given as a nonlimiting illustration, with appended figures which represent.

DETAILED DESCRIPTION

In order to better understand the object of the present invention, the description will be given as a nonlimiting example in the context of a low-profile double antenna used for radio communication equipment, in particular in the 225-400 MHz UHF (ultra-high frequency) band, intended for installation and use on stationary or moving vehicles. The antenna can thus be used in a space diversity context, that is to say that each antenna element operates in the same frequency range. The antenna may operate in transmitting mode, in receiving mode or even in transmitting/receiving mode.

More generally, the antenna structure may also consist of a number of dipoles n with n greater than or equal to 2. Each dipole can be adapted to operate in one and the same frequency range, or even in different frequency ranges.

Figure 3B:
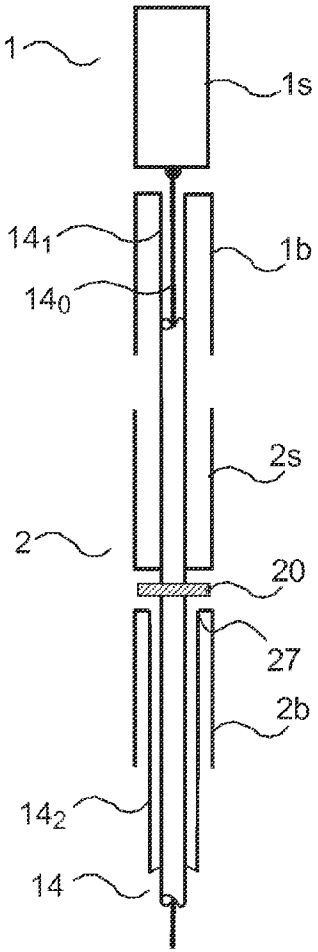
Figure 3A:
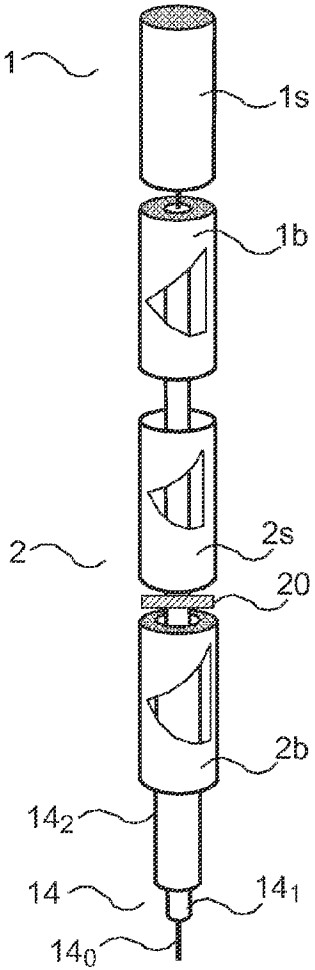

FIGS. 3A and 3B (respectively seen in perspective and seen in cross section) represent an exemplary embodiment of a double antenna according to the invention.

The antenna consists of a first dipole 1 consisting of a top radiating element 1*s* and a bottom radiating element 1*b* forming a skirt (FIG. 3B), the cylindrical form for the radiating elements is taken in the example to make it easier to understand the text, a second dipole 2, placed collinearly to the dipole 1 and consisting of a top radiating element 2*s* forming a counter-skirt (overturned skirt) and a bottom element 2*b* also forming a skirt, a triaxial cable 14 consisting of a core $\mathbf{14}_0$, a first concentric sheath $\mathbf{14}_1$ and a second concentric sheath $\mathbf{14}_2$. For the mechanical strength of the core and of the sheaths, the space between them may in practice be filled with a dielectric material such as polyethylene or PTFE, not represented here for reasons of clarity.

The unbalanced-type power supply of the dipole 1 is produced by the connection of the core $\mathbf{14}_0$ to the top element 1*s* and by the connection of the first sheath $\mathbf{14}_1$ to the bottom element 1*b*, the system may include a broadband impedance matching circuit known to those skilled in the art and inserted between the core $\mathbf{14}_0$ and the element 1*s* which, in order to simplify the understanding of the invention, is not represented.

Figure 2:
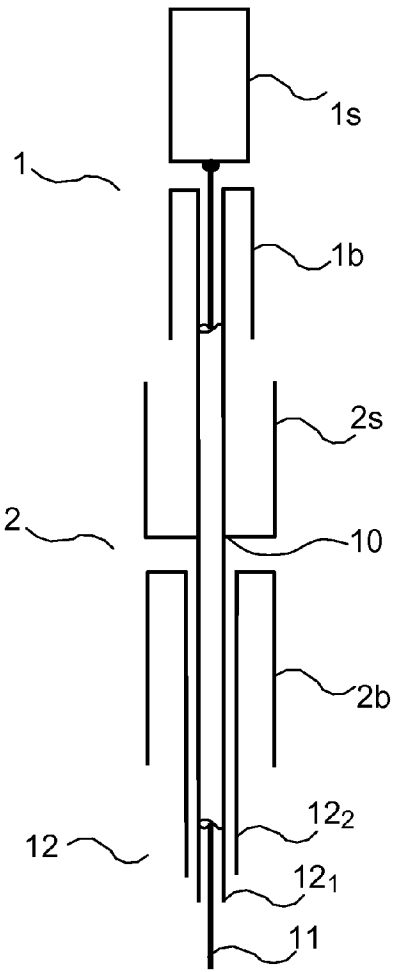
FIG.2 Prior Art
Figure 1B:
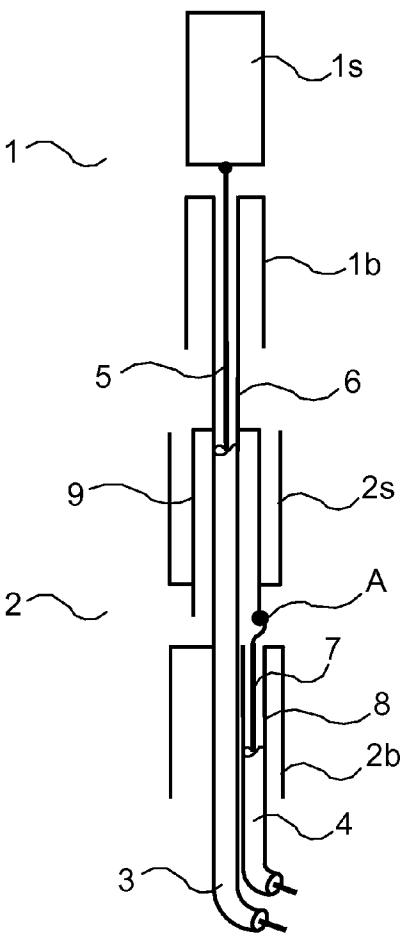
FIG.1B Prior Art
FIGS. 1A and 1B, a first exemplary antenna using a "stub" according to the prior art, FIG. 2, a second exemplary antenna structure according to the prior art, FIGS. 3A, 3B, an exemplary antenna structure according to the invention, FIG. 4, the detail of an exemplary embodiment for the power supply system, FIGS. 5A and 5B, other exemplary embodiments for the power supply system, FIG. 6, an antenna incorporating a mean for limiting, or even cancelling, the leakage currents, FIGS. 7A and 7B, an exemplary embodiment of the device for connecting the antenna structure to the radio sets, and FIG. 8, a schematic representation of the application of the invention to an antenna structure comprising n dipoles, and FIG. 9, the detail of the power supply system for the exemplary antenna of FIG. 8.
Figure 1A:
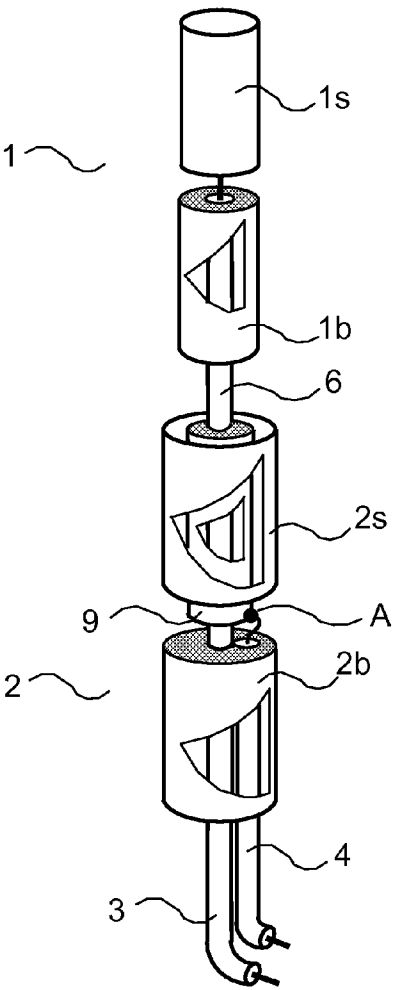
FIG.1A Prior Art
Figure 4:
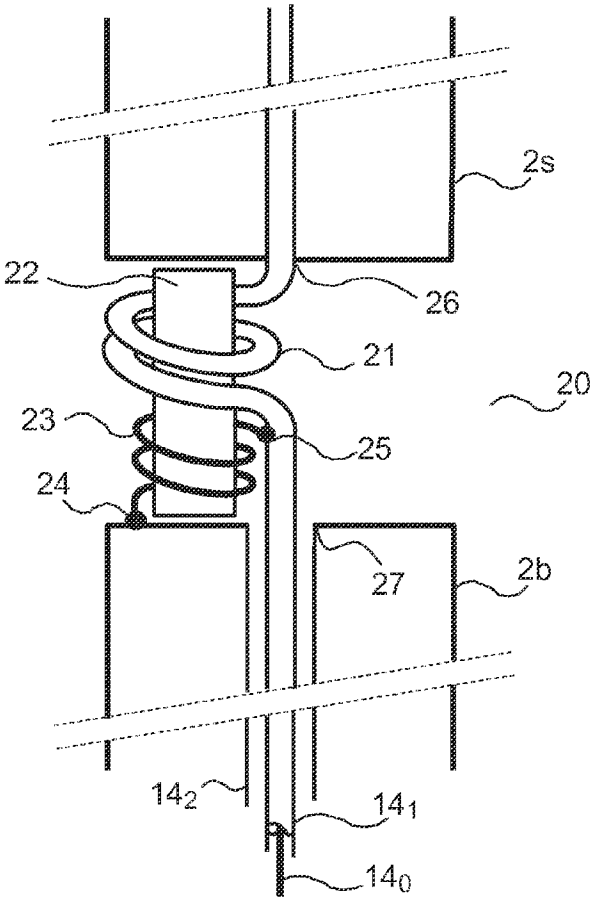

The power supply for the dipole 2 is also of unbalanced type, produced by the connection of the second sheath $\mathbf{14}_2$ to the bottom element 2*b* at the point 27 and by the device 20 detailed in FIG. 4, which is placed between the two elements 2*s* and 2*b*. The device 20 consists, for example, of a winding 21 of the section of cable in the form of Q turns, consisting of the portion of the core $\mathbf{14}_0$ and of the portion of the sheath $\mathbf{14}_1$ situated between these two elements 2*s* and 2*b*, around a magnetic element or core 22, of a secondary winding (P turns) produced by a single-wire cable 23, one of the ends of which is electrically connected to the element 2*b* at the point 24 and the other end of which is connected to the sheath $\mathbf{14}_1$ at the start of the winding 21 (considered starting from the bottom antenna element 2*b* of the dipole) at the point 25, and of a link 26 between the sheath $\mathbf{14}_1$ and the top radiating element 2*s* at the end of the winding 21. The single-wire cable 23 is itself wound around the magnetic core.

Similarly, to make it easier to understand the invention, any additional circuits known to those skilled in the art to improve the broadband impedance matching are not represented; for example, it is possible to mention the use of an LC plug circuit linking the elements 2*s* and 2*b*, and/or an LC resonance circuit placed in series with the secondary winding 23. The function of the element 20 is notably to produce an excitation by magnetic coupling and thus make it possible to widen the frequency band in which the antenna can operate, and do so without having to use so-called "thick" antenna elements and, de facto, without increasing the size of the antenna.

Figure 5B:
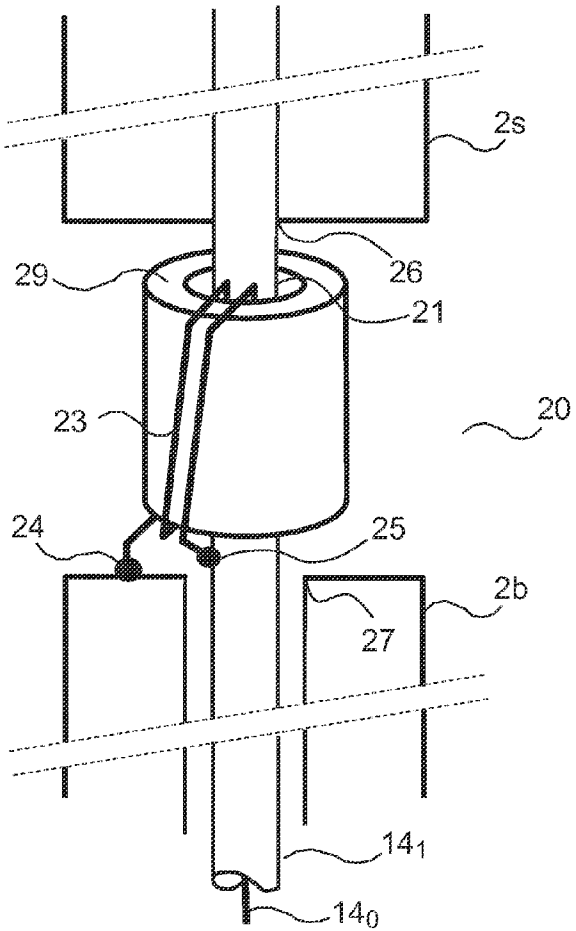
Figure 5A:
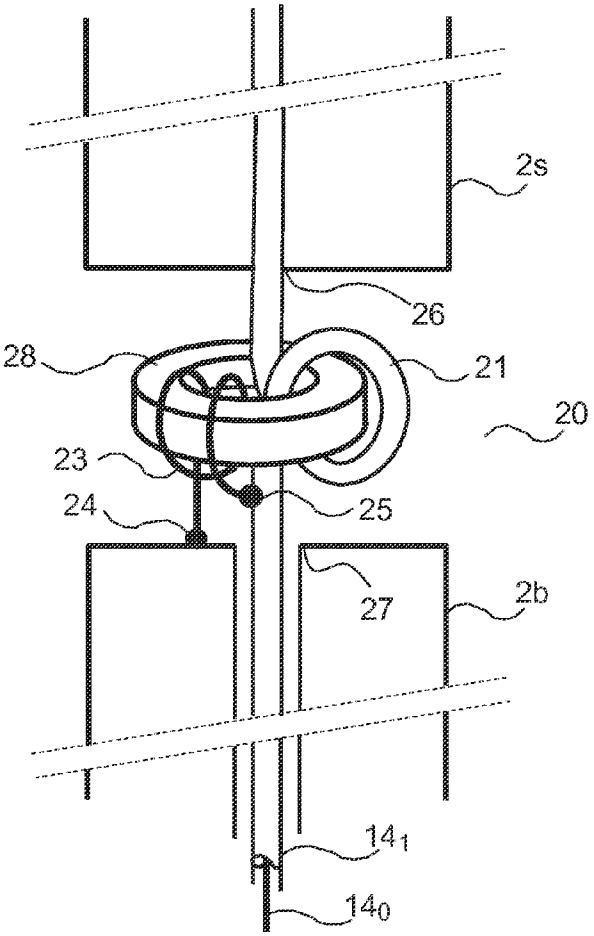

FIG. 5A represents a first variant embodiment for which the magnetic element or magnetic core 22 is a toroid 28. This form advantageously makes it possible to obtain "tighter" magnetic coupling and thereby facilitate the transfer of the RF (radio frequency) power to the radiating elements of the dipole.

FIG. 5B represents another variant embodiment for which the magnetic element or magnetic core 22 is a tube 29. This form makes it possible to use a cable 14 of rigid type which is not suitable for winding.

Figure 6:
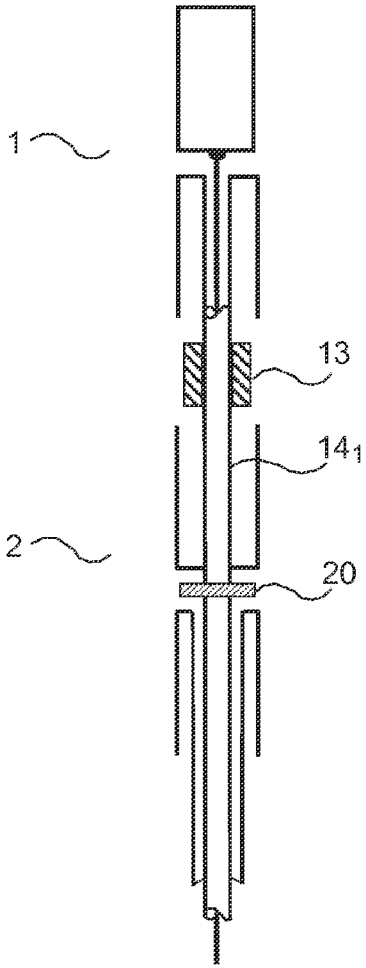

FIG. 6 represents a variant embodiment which makes it possible, notably, to improve the decoupling between the two individual antennas 1 and 2. For example, this type of arrangement is more particularly suited to the case of a use in a multichannel system. To obtain this improvement, the idea is to add ferrite sleeves 13 by arranging them around the sheath $\mathbf{14}_1$ situated between the antennas 1 and 2. The induction effect that is thus produced limits or cancels the leakage or return currents on the surface of the sheath, and thus increases the decoupling between the two individual antennas.

Figure 7B:
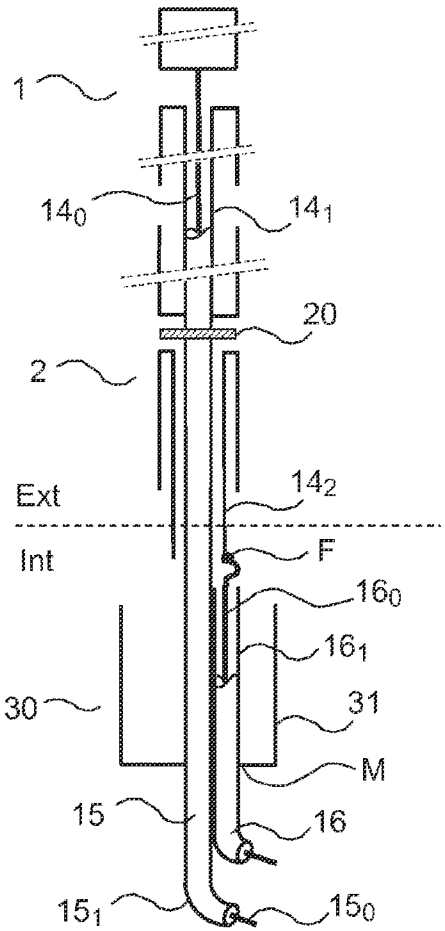
Figure 7A:
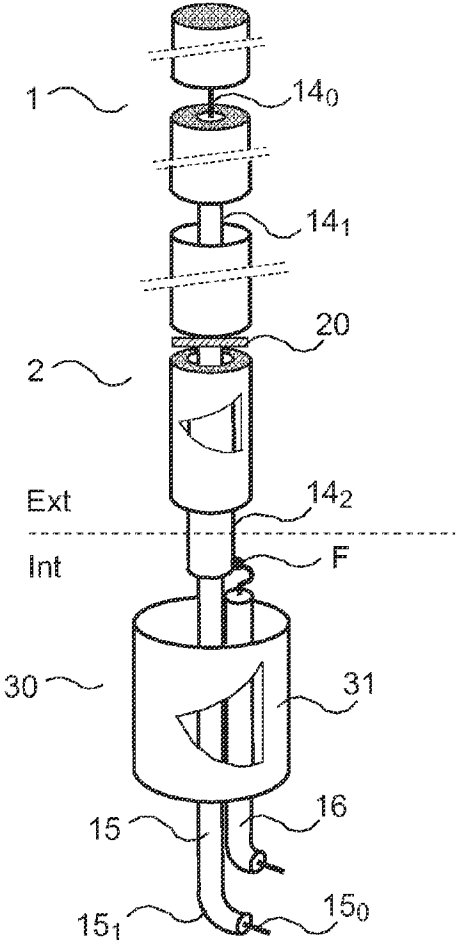

The exemplary embodiment of the double antenna given in order to better understand the invention implements two dipoles. FIGS. 7A and 7B (respectively seen in perspective and seen in cross section) represent an exemplary connection device of balun type that makes it possible to connect the antenna to two transmitter-receiver sets with two separate coaxial cables.

Ext designates the space corresponding to the exterior of the carrier vehicle in which a low profile is required and Int designates the interior of the vehicle.

A preferred exemplary embodiment is to position only the antenna part according to the invention in the space Ext and to install the power device 30 that makes it possible to connect two radio sets in the space Int where no drastic dimensional constraint is imposed.

The device 30 comprises two separate coaxial cables 15 and 16 which make it possible to connect the antenna according to the invention to two separated radio channels. A preferred embodiment is for the core $\mathbf{15}_0$ of the cable 15 to correspond to the extension in the vehicle of the core $\mathbf{14}_0$ of the invention and for the sheath $\mathbf{15}_1$ of the cable 15 to correspond to the extension of the sheath $\mathbf{14}_1$. As for the sheath $\mathbf{14}_2$, this is extended into the space Int only by a length that is sufficient to be connected to the core $\mathbf{16}_0$ of the cable 16 at the point F. The sheaths $\mathbf{15}_1$ and $\mathbf{16}_1$ of the cables 15 and 16 are in contact with one another and are linked to a counter-skirt 31 at the point M to form a system that is usually designated quarter-wave balun by those skilled in the art. The effectiveness of this type of balun becomes correspondingly higher as the relative diameter of the counter-skirt relative to the diameter of the sheaths increases. Given the position of this device inside the vehicle, there is no drastic dimensional constraint in the design of the antenna.

Figure 8:
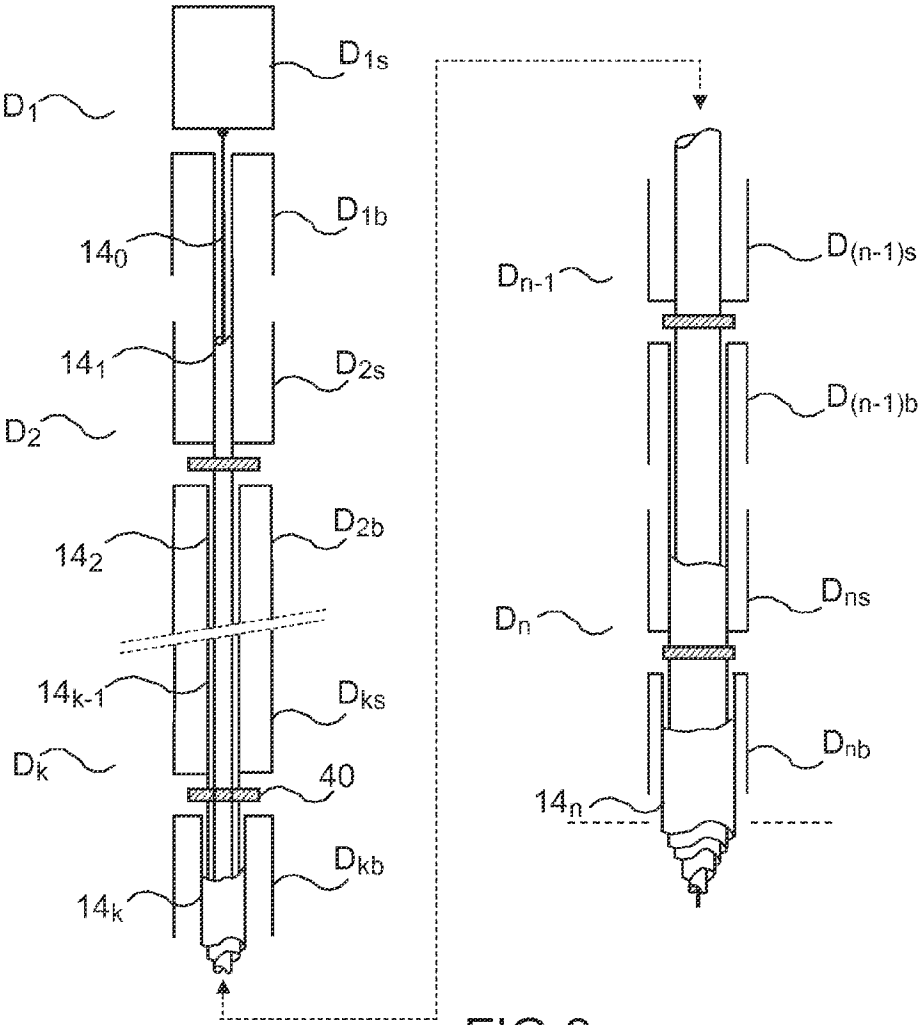

FIG. 8 schematically represents the case where the antenna comprises n dipoles powered by a multi-axial cable consisting of a core and of n concentric sheaths in this example, the antenna has n broadband ports. The antenna with n ports, broadband, with low profile, consists of a collinear stacking of n dipoles powered by a multi-axial cable consisting of a core $\mathbf{14}_0$ and n concentric sheaths $\mathbf{14}_k$, with k=1 to n.

The connections between the antenna elements and the sheath or the core are made as described hereinbelow. A dipole k designated $D_k$ in FIG. 8 consists of a bottom element $D_{kb}$ and of a top element $D_{ks}$, as indicated for example by the elements 2*b* and 2*s* in the preceding figures. The antenna comprises a dipole $D_1$ situated at the top of the antenna, the top antenna element $D_{1s}$ of which is connected to the core $\mathbf{14}_0$ of a multiaxial cable comprising n mutually concentric sheaths and therefore supplied by the latter, and the bottom individual element $D_{1b}$ of which is connected to the first sheath $\mathbf{14}_1$ adjacent to the core $\mathbf{14}_0$. The first sheath is the sheath which is arranged closest to the core, the second sheath $\mathbf{14}_2$ of the multi-axial cable is the sheath arranged between the first and the third sheath $\mathbf{14}_3$, and so on. This arrangement is no more than a convention used for the example of the description.

Figure 9:
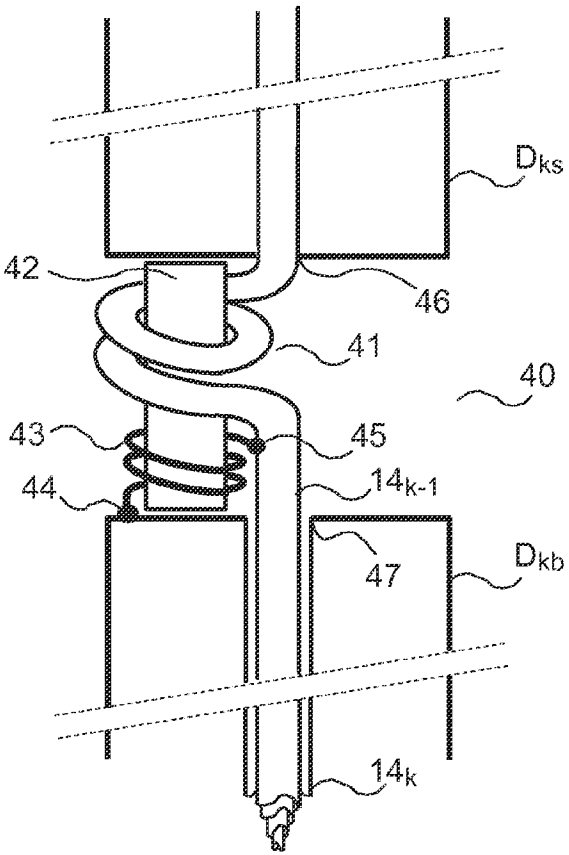

The device 40 (FIG. 9) corresponding to the device 20 described previously is used to connect to the other dipoles. This device 40 is positioned between the top element $D_{ks}$ of the dipole k or $D_k$ and the bottom element $D_{kb}$ of the dipole $D_k$. The top element $D_{ks}$ is connected at the point 46 to the sheath of index (k−1) of the multi-axial cable after the assembly consisting of the sheaths of index (1 to k−1) and the core have been wound in Q turns 41 around a magnetic core 42 and the bottom element $D_{kb}$ of the dipole $D_k$ is connected to the sheath of index k at the point 47 and a single-wire winding of P turns, 43, on the same magnetic core 42 links, at the point 44, this bottom element $D_{kb}$ to the sheath of index (k−1) at the start point 45 of the winding 41 to produce the broadband impedance matching and the power supply for the dipole k or $D_k$.

A double antenna consists of two individual antennas of skirted collinear dipole type, placed one above the other; each individual antenna having its own input.

When the broadband antenna is a two-input antenna, this will make it possible, for example:

either to connect two radio sets that can operate in frequency evasion or EVF mode without requiring a broadband coupler and therefore losses, or to combine the two inputs to form a single radiating assembly with a gain in directivity, or to connect to two reception channels to produce the diversity function in space, or to connect a receiver and a transmitter in the context of a full-duplex system, that is to say, a system with simultaneous transmission and reception.

The antenna can be implemented by using the usual techniques for producing broadband antennas for mobiles, in particular the antennas of the VHF-FM band, VHF-FM standing for very high frequency-frequency modulation, namely:

production of the radiating elements from tubes (solid or braided), protection of the radiating elements under a radome, for example, made of glass-fiber reinforced plastic (robustness, flexibility well suited to repeated impacts on obstacles), production of the connection system which will be placed at the base of the antenna and will have no notable influence on the profile and the size of the antenna.

The antenna or radiating structure according to the invention is a multiple structure of thin collinear dipole type. It implements elements with small transversal dimensions, therefore with low profile, that can operate in a wide frequency band. It presents a smaller profile than the known broadband antennas through the implementation of a thin dipole structure and a matching circuit instead of a so-called "thick" structure. It offers optimization of the physical dimensions of the power supply system by multi-axial cable and magnetic coupling instead of a power supply by "stub". It also offers the possibility of adding complementary circuits to improve the impedance matching. Its structure is suitable for use on a moving vehicle, for a tactical multi-station use. It also offers the possibility of coupling in transmission: +3 dB of directivity, a possibility of spatial diversity in reception: fight against the phenomenon known as "fading".

The invention claimed is:

1. A low-profile broadband multiple antenna comprising at least two dipoles ($D_k$), each dipole k designated $D_k$ consisting of a top antenna element $D_{ks}$ and a bottom antenna element $D_{kb}$, said antenna being powered by a coaxial cable comprising a core and n sheaths arranged concentrically around the core, with k varying from 1 to n, comprising:

a dipole $D_1$ (k=1) arranged in the top part of said antenna, said dipole $D_1$ comprising at least one first top antenna element $D_{1s}$ connected to the core of said multi-axial cable comprising n sheaths and the bottom individual element $D_{1b}$ of which is connected to the first sheath adjacent to the core, a connection device positioned between a top element $D_{ks}$ of a dipole $D_k$ (k>1) and the bottom element $D_{kb}$ of said dipole $D_k$, the top element $D_{ks}$ is connected at a point to the sheath of index (k−1) of the multi-axial cable after the assembly comprising the core and the sheaths of index (1 to k−1) has been wound in Q turns around a magnetic core and the bottom element $D_{kb}$ of the dipole $D_k$ is connected to the sheath of index k at the point, wherein said connection device comprises at least one single-wire winding of P turns arranged on the same magnetic core links, a bottom point of said bottom element $D_{kb}$ of said dipole $D_k$ to the sheath of index (k−1) at the point corresponding to the start of the winding in order to provide the broadband impedance matching and the power supply for the dipole $D_k$.

2. The antenna as claimed in claim 1, wherein the magnetic element is a toroid or a tube.

3. The antenna as claimed in claim 1, wherein all the dipoles $D_k$ forming said antenna operate in the same frequency range, are powered with the same power value.

4. The antenna as claimed in claim 1, wherein the dipoles $D_k$ forming the antenna are powered with different powers.

5. An antenna system comprising at least one antenna as claimed in claim 1 comprising two dipoles, each dipole $_k$ designated $D_k$ consisting of a top antenna element $D_{ks}$ and a bottom antenna element $D_{kb}$, said antenna being powered by a coaxial cable comprising a core and two sheaths arranged concentrically around the core, with $_k$ equal to 1 or 2, and further comprising two separate coaxial cables and allowing said antenna to be connected to two separated radio channels, wherein the core of the first cable corresponds to the extension in the vehicle of the core of the invention, and the sheath of said first cable corresponds to the extension of a first sheath, and wherein a second sheath extends into the space Int only by a length sufficient to be connected to the core of the second cable at a point F, and said sheaths and of the first cable and the second cable are in contact with one another and are linked to a counter-skirt at a point M to form a quarter-wave balun system.

6. The antenna and antenna system as claimed in claim 5, wherein the dipoles are adapted to operate in the frequency range from 225 to 400 MHz.

7. The antenna as claimed in claim 1, wherein the dipoles are adapted to operate in the frequency range from 225 to 400 MHz.

* * * * *